United States Patent [19]

Dogliotti

[11] 4,175,665

[45] Nov. 27, 1979

[54] DISPLAY CONTAINER FOR ROUNDED ARTICLES

[75] Inventor: Amilcare Dogliotti, Alba, Italy

[73] Assignee: P. Ferrero & C. S.p.A., Alba, Italy

[21] Appl. No.: 861,338

[22] Filed: Dec. 16, 1977

[30] Foreign Application Priority Data

Feb. 7, 1977 [IT] Italy ..... 52895/77[U]

[51] Int. Cl.[2] ..... A47F 1/00

[52] U.S. Cl. ..... 211/49 D; 46/43; 221/312 R

[58] Field of Search ..... 211/49 D; 221/312 R; 312/49; 46/43; D6/157, 20; 273/120 R

[56] References Cited

U.S. PATENT DOCUMENTS

| | | | |
|---|---|---|---|
| D. 133,432 | 8/1942 | Booher | D6/20 |
| 2,221,704 | 11/1940 | Farley | 312/49 |
| 2,299,403 | 10/1942 | Mozel | 221/312 R X |
| 2,382,191 | 8/1945 | Weichselbaum | 211/49 D |
| 2,388,483 | 11/1945 | Hess | 46/43 X |
| 2,780,508 | 2/1957 | Bonderer | 312/49 |
| 2,931,131 | 4/1960 | Morse | 46/43 |
| 3,028,704 | 4/1962 | Rumbaugh | 46/43 |
| 3,801,094 | 4/1974 | Treaster | 46/43 X |

*Primary Examiner*—Roy D. Frazier
*Assistant Examiner*—Robert W. Gibson, Jr.
*Attorney, Agent, or Firm*—Sughrue, Rothwell, Mion, Zinn and Macpeak

[57] ABSTRACT

A display container for rounded articles, particularly confectionery articles such as toffees, dragees or chocolates, in the form of a helical chute constituted by a web having a transverse flange turned several times around a support pillar projecting up from a base; the flange has two recesses at the bottom end next to the base to facilitate removal of the bottom article, which is held in a pocket formed between a radial abutment wall and the end of the web which is stopped slightly short of the base, the flange continuing to the abutment wall.

1 Claim, 3 Drawing Figures

DISPLAY CONTAINER FOR ROUNDED ARTICLES

The present invention relates to a display container for rounded articles, and in particular to a container for displaying round sweetmeat products, such as toffees, dragees, chocolates and the like.

It is a feature of the present invention that embodiments thereof can be formed as containers in which the displayed articles are attractively arranged, and from which the displayed articles may be removed in order, one at a time, for sale to the consumer.

According to the present invention a display container for rounded articles comprises a support pillar which projects upwardly from a base, and around which are a plurality of turns of a helical web at the radially outer edge of which is a transverse flange extending from the web, in a direction generally parallel to the said support pillar at least away from the said base to define, with the web, a helical chute for the articles to be contained by the container, the chute having abutment means adjacent the base so as to restrain the lowermost article therein, the transverse flange having at least one recess at a position adjacent the said abutment means to facilitate removal of the lowermost article from the chute by displacing it radially with respect to the support pillar.

One embodiment of the present invention will now be more particularly described, by way of example, with reference to the accompanying drawings, in which.

Figure 1:
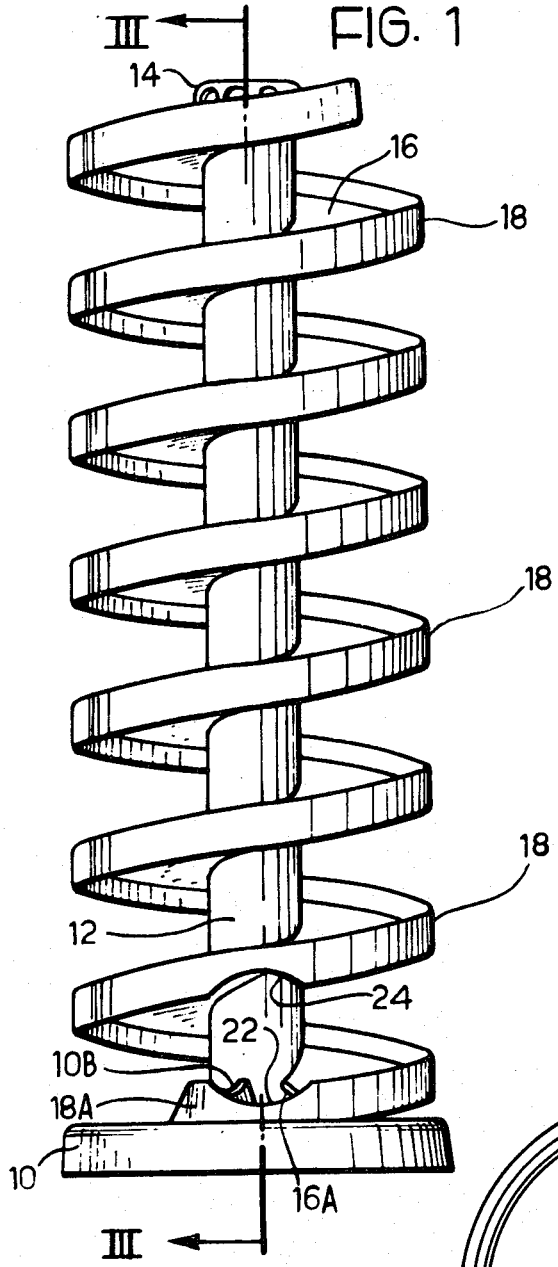
FIG. 1 is a side view of the embodiment.
Figure 2:
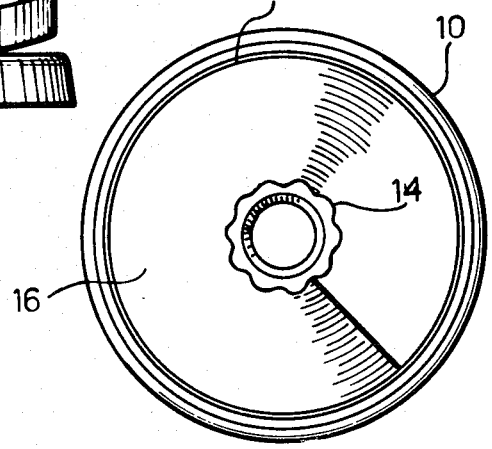
FIG. 2 is a plan view from above of the embodiment.

Referring now to the drawings, the embodiment shown has a base plate 10 of circular shape with a diameter of about 17 cm. The base plate 10 is preferably moulded from plastics material, although other materials can be used if desired. From the centre of the base plate 10 there projects upwardly a support pillar 12, also having a generally circular cross-section, with an outer diameter in the region of 4 cm.; the height of the pillar 12 in this embodiment is 45 cm. The pillar 12 is constituted by a length of rigid tube of plastics material, fixed to a boss 10A projecting up from the centre of the plate 10. The tube forming the pillar 12 is closed at the top by a cap 14.

Secured to the pillar 12 is a helical web 16 of plastics material, forming approximately seven complete turns spaced uniformly from each other. The outer diameter of the turns is 16 cm., and the spacing S between adjacent turns of the web is in the region of 5.5–6 cm.

Around the outside edge of the web 16 there is attached, for example by welding or adhesive, a strip 18 of plastics material. The strip 18 is attached along a longitudinal centre line thereof, so that it forms a double flange having a first part 18A projecting upwards in relation to the web 16, and a second part 18B projecting downwards. The width of the strip is about 2 cm. so that the spacing S' between the adjacent edges of the turns of the strip 18 is in the region of 3.5–4 cm.

Figure 3:
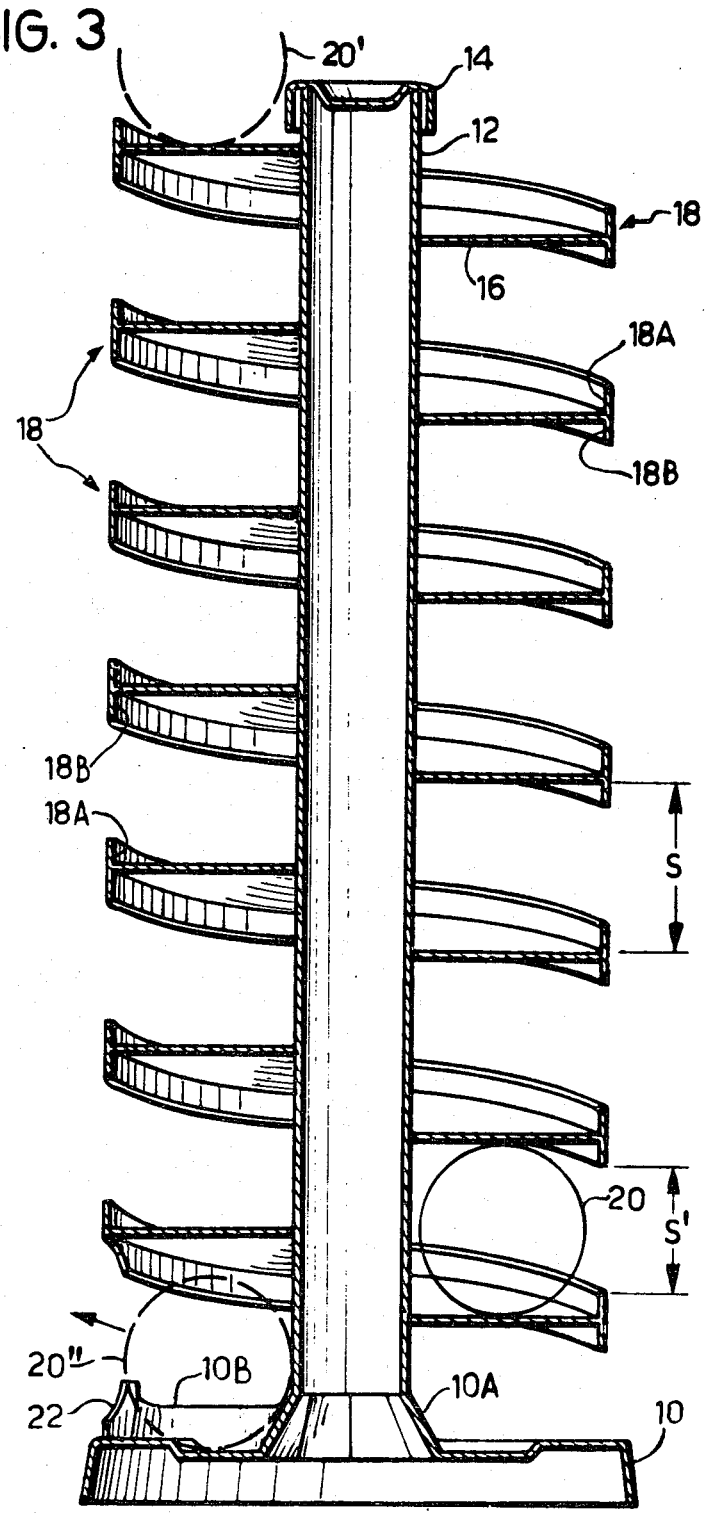
FIG. 3 is an axial section taken on the line III—III of FIG. 1.

In FIG. 3 the circle 20 represents in outline a typical article for which the display container is designed; with the dimensions given above, the diameter of the article 20 may vary from a little more than the value S' up to a little less than the value S. Usually, of course, all the articles held in the display container would have the same diameter, but this will not necessarily always be the case. The container can be loaded simply by placing the articles on the highest point of the helical web, shown 20'; the article then rolls down the helical chute formed by the web 16 and flange 18, so as to reach the lowest position, shown as 20'', where it engages an abutment stop in the form of a radial wall 10B. When the container is fully loaded about forty of the articles are arranged in a helical row around the pillar 12.

The lower terminal edge 16A of the web 16 is, in fact, spaced a few centimeters away from the radial wall 10B, and in a position where it is still about 1 cm. above the plate 10, so that between the radial wall 10A and the end 16A of the web 16 there is formed a pocket constituting a trap for the lowermost article 20''. In order to complete this pocket the upper flange 18A formed by the strip 18 extends beyond the end of the said edge 16A, as far as the radial wall 10B, as can be seen readily in FIG. 1. The projecting part of the strip 18 is welded or stuck on to the plate 10. The upper edge of this projecting part of the strip 18 is formed with a notch 22 in the form of the arc of a circle, and a similar notch 24 is made in the section of the downwardly projecting flange 18b which is immediately above the notch 22: Thus the lowermost article 20'' can be manually extracted radially from the display container, and the whole row of articles can then move down by a distance equal to the diameter of the article which has been removed.

What is claimed is:

1. A display container and dispenser for spherical articles, comprising:

a base, a support pillar rigidly secured to and projecting upwardly from said base, a plurality of turns of a continuous helical web surrounding said support pillar with the innermost edge in contact with said pillar and attached thereto, a transverse flange extending from the radially outer edge of said web, said flange projecting in opposite directions from said web generally parallel to said support pillar to define, with said web, a helical chute for articles to be contained by said container, abutment means on said base extending radially with respect to said pillar, said abutment means serving to restrain the lowermost article in said chute, recess means in said transverse flange at a position adjacent said abutment means whereby to facilitate removal of the lowermost article from said chute by displacing it radially with respect to said support pillar, and said lowermost end of said helical web being spaced from said abutment means and from said base whereas said transverse flange extends substantially up to said abutment thereby forming a pocket for the lowermost article in said chute.

* * * * *